United States Patent [19]

Kutilin

[11] Patent Number: 4,805,678

[45] Date of Patent: Feb. 21, 1989

[54] METHOD AND APPARATUS FOR PRETREATING AND DEBARKING LOGS

[75] Inventor: Eugen E. Kutilin, White Rock, Canada

[73] Assignee: Beloit Corporation, Beloit, Wis.

[21] Appl. No.: 120,289

[22] Filed: Nov. 12, 1987

[51] Int. Cl.[4] ..... B27L 1/00

[52] U.S. Cl. ..... 144/342; 144/208 R; 144/341

[58] Field of Search ..... 144/208 R, 208 E, 341, 144/342

[56] References Cited

U.S. PATENT DOCUMENTS 2,881,814 4/1959 Avared ..... 144/342

3,119,422 1/1964 Brown ..... 144/209 E 3,221,785 12/1965 Valo ..... 144/208 E 3,991,800 11/1976 Palmquist ..... 144/208 E 4,432,403 2/1984 Heikkinen ..... 144/208 B

*Primary Examiner*—W. Donald Bray

*Attorney, Agent, or Firm*—Dirk J. Veneman; Raymond W. Campbell

[57] ABSTRACT

An apparatus for pretreating and debarking logs wherein the log is debarked by a plurality of cutting elements disposed at an angle to the longitudinal extent of the log and offset with respect to each other. The cutting elements include top and bottom cutting elements between which the log is rolled, imparting helical slits thereto.

23 Claims, 6 Drawing Sheets

METHOD AND APPARATUS FOR PRETREATING AND DEBARKING LOGS

BACKGROUND OF THE INVENTION

1. Field of the Invention

This invention relates generally to the wood processing industry, and more specifically relates to a method and apparatus for pretreating logs before conventional debarkers, or for replacing conventional debarkers in removing bark from logs.

While generally having utility for removing bark from all log species, the invention is seen as having its greatest advantage for removing bark from log species normally considered to be difficult or troublesome to debark.

2. Description of Prior Art

In many log utilizing industries, such as the papermaking industry, it is desirable to remove the bark from whole logs before further processing. In the past, several different types of debarkers have been used, generally groupable into three main categories based on the operating principles by which the bark is removed.

One general category of debarker, known as hydraulic debarkers, utilizes high pressure water jets to separate the bark from the log. Hydraulic debarkers include designs in which a single water jet traverses the log longitudinally, initially opening the bark layer. The log is rolled on its longitudinal axis, and the water jet used to separate the bark further around the circumference of the log, until the bark is completely separated from the log. In other types of hydraulic debarkers, a plurality of stationary or oscillating water jets are positioned around the circumference of a log, which transverses longitudinally, and the water jets separate the bark from the log.

While working well for some wood species and in some mill applications, hydraulic debarkers do not work well for species in which the bark is generally difficult to remove, and all hydraulic debarkers present operational disadvantages, in that very large volumes of water are used, and must be treated after use. Thus, the environmental concerns for water treatment are significant, and the cost for equipment and for operating water treatment facilities can be high. Additionally, bark removed by hydraulic debarkers is wet and soggy; therefore, being difficult to handle after removal.

A second general category of debarker currently used is referred to as mechanical debarkers. In one type of mechanical debarker, a plurality of cutting tools are positioned around the circumference of the log, and the tools are rotated around the log as the log travels therebetween, The tools strip the bark from the log. This type of debarker is inefficient for short logs, and is generally prone to mechanical failure. Additionally, mechanical debarkers work well only for log species in which the bark readily fractures. Stringy types of bark tend to separate from the log in large sheets and wrap around the cutting tools, thereby making handling difficult.

In another type of mechanical debarker, the logs are positioned on two support rolls, and a cutting or grinding roll is positioned above the log. As the log is rolled, the roll grinds the bark from the log.

A third general category of debarker is known as a drum debarker, in which a large drum having surface elements on the inside thereof for cutting bark, receives a plurality of logs at one time. The drum is rotated to tumble the logs, and the surface elements remove the bark from the log. Drum debarkers normally are designed with slotted openings for bark to fall from the drum.

Mechanical debarkers and drum debarkers do not work well on severely bowed logs when cutting tool contact along the log is restricted. In Northern climates, bark removal efficiency is reduced substantially when logs become frozen, regardless of the type of debarker being used. In some situations, it has been found necessary to subject logs to several consecutive debarking operations in order to achieve acceptable levels of bark removal.

Certain wood species present debarking difficulties. For example, eucalyptus, aspen, and other species at certain stages of log freshness or at certain times of the year actually debark too easily. The bark separates in large sheets, which clog debarking tools and generally are difficult to handle. In a drum debarker, bark from fresh eucalyptus will often accumulate in large balls that stay in the debarker and are removed therefrom only when the logs are removed. Apparatus must be provided to separate the bark pieces from the debarked logs, to ensure that the bark does not accompany the logs into subsequent log processing steps. In spite of these difficulties, drum debarkers are still most frequently used for eucalyptus, aspen and the like, in that the other types of debarkers are even less effective with these species than are the drum debarkers.

Handling bark removed from certain species is also difficult. The large bark sheets from eucalyptus can plug conveyors and will often intertwine in holding bins and adhere to each other, such that the entire bin of bark becomes a single mass. To alleviate this, separate bark handling process lines are often used, including chopping appratus for reducing the size of the bark pieces. Such apparatus is expensive to obtain and is subject to clogging and mechanical failure during operation.

In the past, complicated pretreating devices have been used with some log species in an attempt to facilitate bark removal and handling; however, most such devices have generally been prohibitively expensive and operationally ineffective.

SUMMARY OF THE INVENTION

A principle object of the present invention is to provide a method and apparatus for pretreating and debarking logs that overcome many of the difficulties associated with debarking eucalyptus, aspen, and other wood species that present debarking problems.

It is another object of the present invention to provide a pretreatment apparatus and debarker that can be used for removing bark from all types of wood, and which operates at a high level of bark removing efficiency when processing short logs, frozen logs and logs of odd shape; eliminating the need for multiple debarking operations.

A further object of the present invention is to provide an apparatus useful as a preconditioning unit for other types of debarkers to increase bark removing efficiency when processing troublesome species, and to render the removed bark easier to handle.

A still further object of the present invention is to provide a debarker that simplifies subsequent bark handling processes while increasing bark removal efficiently, and which eliminates the need for equipment to reduce the size of removed pieces of bark.

These and other object are achieved in the present invention by providing an apparatus in which a plurality of cutting elements are provided above and below the log to be debarked, at an angle with respect to the longitudinal axis of the log. The top and bottom cutting elements are offset with respect to each other, with the lower cutting elements being disposed in horizontal alignment between the adjacent upper cutting elements, and vice versa. The log is rolled between the cutting elements, and the cutting elements score the bark layer, imparting helical slits thereto. the score lines created by the cutting elements define diamond shaped regions of bark between them. Scraping tools can be provided on the apparatus to remove the bark in diamond shaped pieces, or the preconditioned log can be passed through other types of debarkers for actual bark removal.

In a particularly advantageous design useful in practicing the method of the present invention, the top and bottom cutting elements are disposed in bed-like arrangements and the log is placed at one end of the lower bed. The upper bed is positioned above the log, only minimally overlapping the lower bed. After the log has been positioned on the lower bed, the upper bed is brought against the log with sufficient pressure to cause the cutting elements to pierce the bark layer. The upper bed is then advanced over the lower bed. The resultant movement is such that the log will roll between the beds and the angularly disposed cutting surfaces will score the log as described.

Additional objects and advantages of the present invention will become apparent from the following detailed description and the accompanying drawings.

BRIEF DESCRIPTION OF THE DRAWINGS

FIG. 8 is an enlarged cross sectional view showing a particularly suitable knife embodiment for the present debarking apparatus, operating on a bowed log.

DETAILED DESCRIPTION OF PREFERRED EMBODIMENTS

Figure 1:
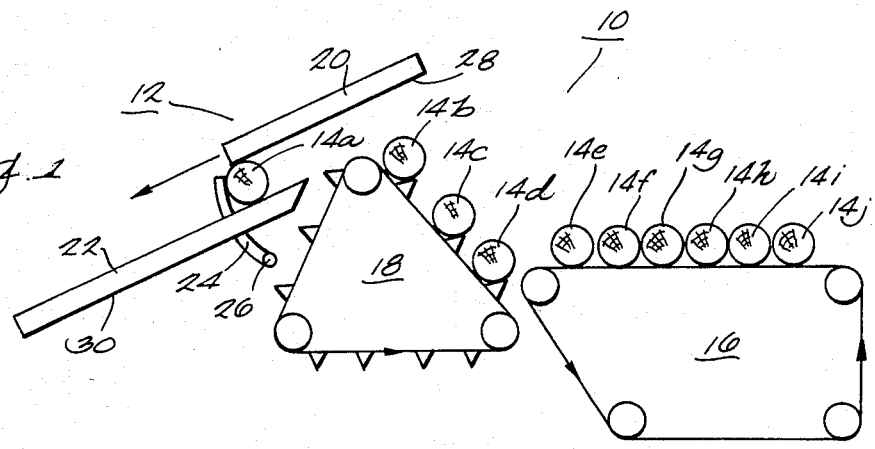
FIG. 1 is a schematic illustration of a debarking process including the debarking apparatus of the present invention, as debarking of a log is begun.

Referring now more specifically to the drawings, and to FIGS. 1 through 5 in particular, numeral 10 illustrates a debarking process in which a debarking apparatus 12 of the present invention is utilized for removing bark from logs designated by numerals 14*a* through *j*. The process apparatus further includes a log supply conveyor 16, and a singling conveyor 18 for supplying logs individually to the debarking apparatus 12. The conveyors 16 and 18 can be of any suitable design known to those skilled in the art, do not constitute a part of the present invention, and will not be described in more detail herein.

The debarking apparatus 12 includes an upper bed cutting assembly 20 and a lower bed cutting assembly 22. It should be recognized that the upper and lower bed assemblies 20 and 22 will be at least as wide as, and preferably slightly wider than the length of the longest logs to be debarked thereon. In the process depicted in FIGS. 1 through 5, individual logs are fed from the singling conveyor 18 to the debarking apparatus 12. A log positioner 24 pivotally connected at 26 is provided for receiving and positioning the log from the singling conveyor 18. The log positioner 24 may consist of a plurality of retaining arms located across the debarking apparatus, and should include at least positioners near each end of a log, and perhaps intermediate the log ends. The log positioner may take different forms, but should operate to catch and position the logs from the singling conveyor until the debarking operation commences, at which time the log positioner or positioners will be moved from the elevated position to a retracted position, thereby allowing the log to roll along the lower bed assembly. In this regard, the log positioner 24 can be spring-loaded, to be pushed out of the way by the rolling action of the log, or the retainer can be positively controlled to be moved out of the way through mechanical operation.

In the debarking apparatus 12, as illustrated in FIGS. 1 through 5, the lower bed cutting assembly 22 is stationary, and the upper bed cutting assembly 20 moves thereover, substantially parallel to the lower bed assembly, during operation of the apparatus. Each of the upper and lower bed cutting assemblies 20 and 22 include a plurality of cutting edges 28 and 30, respectively, disposed in spaced relationship at locations across the longitudinal extent of the log. During operation, the cutting edges penetrate the bark layer circumferentially about the log as the log rolls. It will be recognized that as the upper bed cutting assembly moves toward the lower end of the lower bed cutting assembly the sliding motion will cause the log 14a to roll. Further details of the cutting edges will be described hereinafter.

Figure 4:
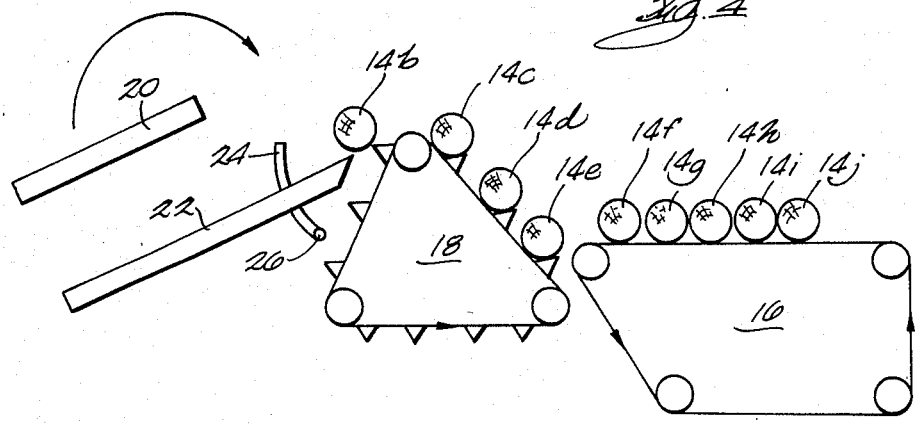
FIG. 4 is a schematic illustration similar to the previous figures, but illustrating the debarking apparatus at the log loading step.
Figure 5:
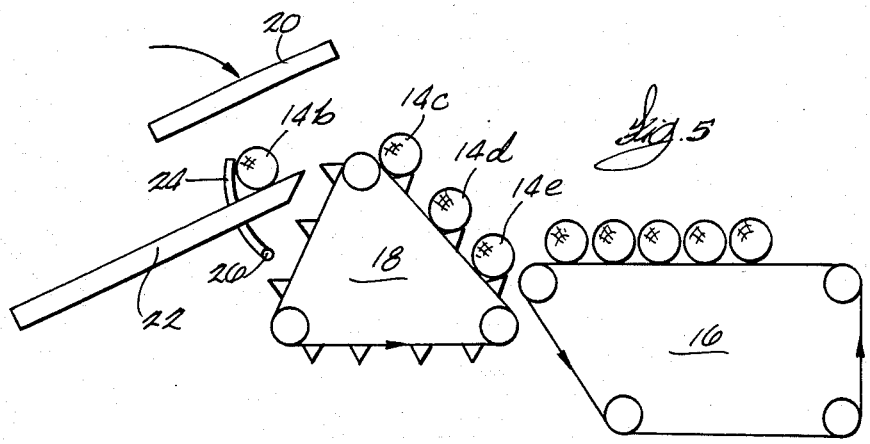
FIG. 5 is a schematic illustration similar to the previous figures, depicting the debarking apparatus as the log loading step is completed, and just prior to commencement of bark removal.

As shown particularly in FIGS. 4 and 5, the upper bed cutting assembly 20 is operationally mounted to be raised out of the way during the log loading steps. It will be apparent to those skilled in the art that a suitable frame permitting translational movement of the upper bed over the lower bed can be provided, and the upper bed can be mounted on pneumatic, hydraulic, or other devices allowing it to be picked up for return movement to the upper end of the lower bed assembly. The design of the supporting frame work for the upper bed assembly will be one of design choice, and in and of itself does not constitute a part of this invention.

The upper and lower bed cutting assemblies 20 and 22 have been shown to be positioned at an angle with respect to the horizontal, and it is felt that such an orientation will be beneficial in the log loading and debarking process, in that the natural tendency of the logs to roll can be utilized. It should be recognized, however, that, in some applications, the beds may be disposed substantially horizontal, or at angles greater than or less than the angle shown in the drawings.

Figure 6:
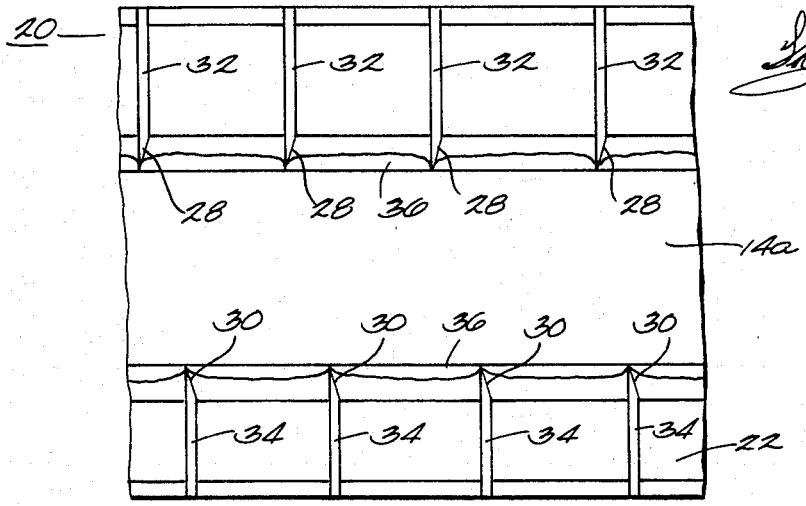
FIG. 6 is an enlarged, fragmentary cross-sectional view of the debarking apparatus shown in FIG. 2, taken along line 6—6 of FIG. 2.
Figure 7:
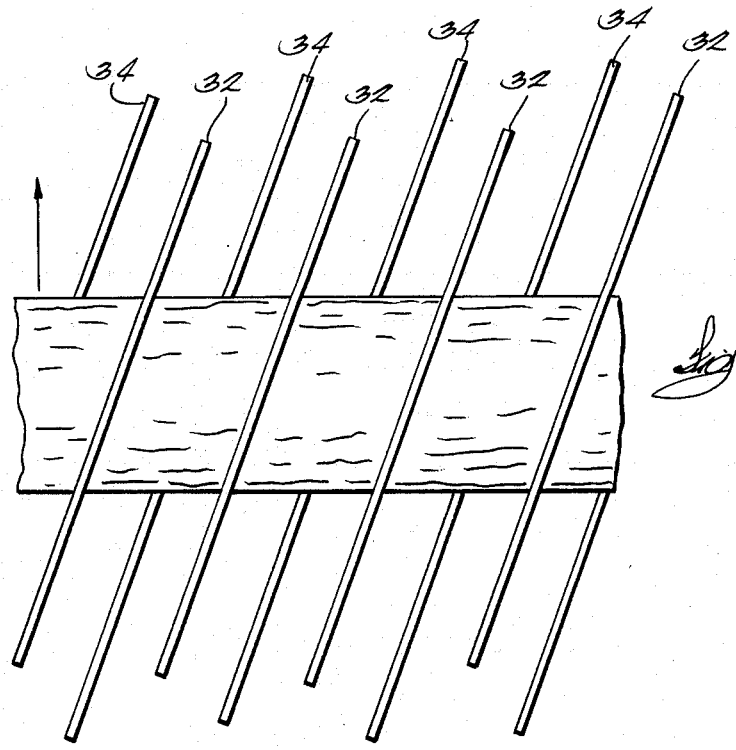
FIG. 7 is an enlarged top view showing the knife arrangement.
Figure 6:
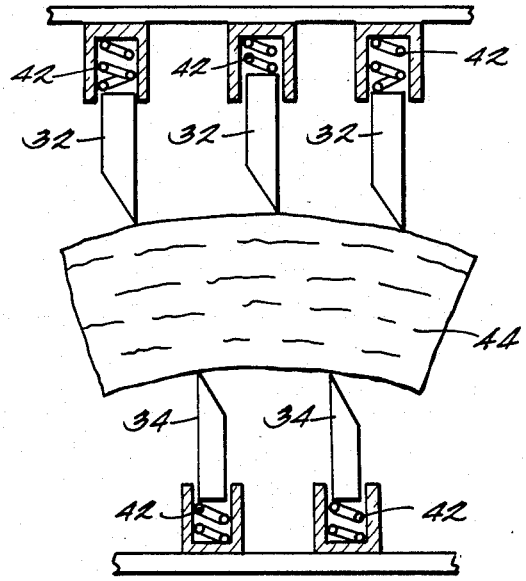
Figure 15:
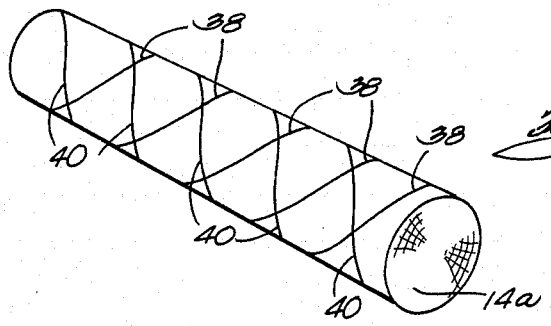
FIG. 15 is an illustration of a log on which scoring lines are shown after processing through the present apparatus.

Referring now more specifically to FIGS. 6 and 7, the upper bed cutting assembly 20, lower bed cutting assembly 22, and cutting edges 28 and 30 will be described in more detail. As stated previously, a plurality of cutting edges 28 are provided in the upper bed assembly, and a plurality of cutting edges 30 are provided on the lower bed cutting assembly. The cutting edges depicted are sharpened edges on knives 32 and 34 of upper and lower bed assemblies 20 and 22, respectively, and the knives are disposed at an angle with respect to the axis of a log as it is rolled through the debarking apparatus. The upper and lower knives are parallel, but are not vertically aligned. As the log rolls through the debarking apparatus, each knife penetrates the bark layer 36 and imparts a helical cut or slit in the bark. As a result of the angular orientation of the knives with respect to the movement of logs through the apparatus, and the vertical misalignment between the upper and lower knives, the helical slits imparted by the knives intersect at various locations about the circumference of the log. Thus, as more clearly shown in FIG. 15, the upper and lower bed cutting assemblies operate cooperatively to create discrete, generally diamond shaped bark pieces separated from each other by the helical slits 38 and 40. The size of the bark pieces is controlled by the spacing between adjacent blades and the angle at which the blades are disposed relative to the direction of log movement. Therefore, a debarking apparatus of the present invention can be designed to provide optimal bark size for bark handling operations following the debarker, and may eliminate the need for bark hogging operations, or other steps necessary for reducing bark size for subsequent processing.

Although the knives shown in FIGS. 6 and 7 are depicted as being solid throughout their extent across the debarking apparatus, it may be desirable to provide the knives as segmented sections, separatedly mounted. As shown in FIG. 8, each blade segment can be adjustably mounted by springs 42 or the like, to permit vertical movement. This type of mounting is particularly advantageous for the debarking of irregular or bowed logs. It is also advantageous if the logs vary in diameter from one end thereof to the other. The vertical adjustability of the knives permits each to contact the log at the necessary location. It will be recognized that, in this regard, relatively short knife segments would be preferable to knives extending across the entire dimension of the upper or lower bed. FIG. 8 illustrates how each knife can assume the proper vertical position for the log being debarked. An exaggerated bow is shown in a log 44 in FIG. 8. Each knife can adjust upwardly or downwardly as a high or low surface of the log is presented.

Figure 9:
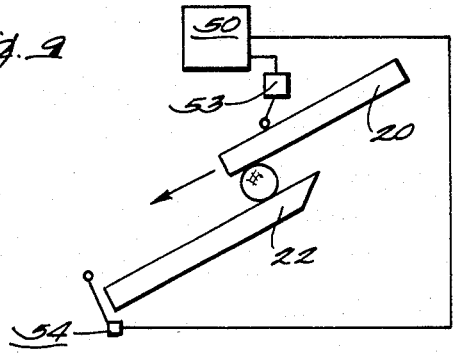
FIGS. 9 and 10 schematically illustrate basic control circuitry for the debarking apparatus.
Figure 10:
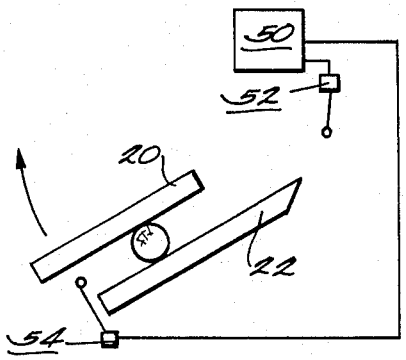

In utilizing the present debarking apparatus, it is necessary only to roll the log one full rotation. After one revolution, each blade will have performed a helical slit about the log, intersecting with slits of adjacent knives, and slits made by knives from the opposite cutting bed assembly. Since it is likely that any debarking apparatus will receive logs of varying diameters, it is desirable to provide means for determining the log diameter and adjusting the operation of the apparatus to correspond to the log diameter. In FIG. 9, a microprocesing unit 50 is shown operationally connected to a location sensing mechanism 52 for the upper bed cutting assembly. Sensing means can be provided for determining the location of the upper bed cutting assembly after it is brought into contact with the log. Since the lower bed cutting assembly is stationary, the distance between the upper bed cutting assembly and the lower bed cutting assembly can be calculated, or, alternatively, the position of the upper bed cutting assembly with respect to its supporting frame work can be determined, and the circumference of the log calculated therefrom. Those skilled in the art will recognize that different types of sensing mechanisms can be used, such as, for example, proximity switches, photoelectric sensors, or the like. Those skilled in the art will also recognize that other controls are desirable for sensing when a log has been properly located against the log positioner 24, and when a processed log has been removed from the assembly. In FIGS. 9 and 10, a proximity switch 54 is shown for sensing when the log has been removed from the apparatus. Operation of the supply conveyors and the debarker can be automated in response thereto. Alternatively, the device can be controlled manually.

To ensure complete circumferential scoring of the bark, it is desirable to slightly exceed one revolution of the log. Therefore, the translational operation of the upper bed cutting assembly over the lower bed cutting assembly can be limited to just slightly greater than the calculated log circumference. As shown in FIG. 10, it is advantageous to limit operation to this distance, so that the greatest efficiency of log processing can be reached.

As described heretofore, the present apparatus scores the bark to define discrete diamond shaped bark pieces. Logs so pretreated can be passed to other debarking apparatus, such as drum debarkers, ring debarkers, or the like for actual bark removal. For tree species such as eucalyptus, aspen, and the like which have stringy bark presenting debarking and bark handling difficulties as described previously herein, the present apparatus for pretreating the bark eliminates these problems. The bark pieces, once removed from the log, are small and easily handled. The bark will not conglomerate in a drum debarker, as described previously, but will fall easily therefrom through the open spaces. Large sheets of bark will not accumulate in and around ring debarkers, and the operational efficiency of a ring or drum debarker in processing eucalyptus, aspen, and similar species, will be improved by using the present invention for pretreating the logs.

Figure 11:
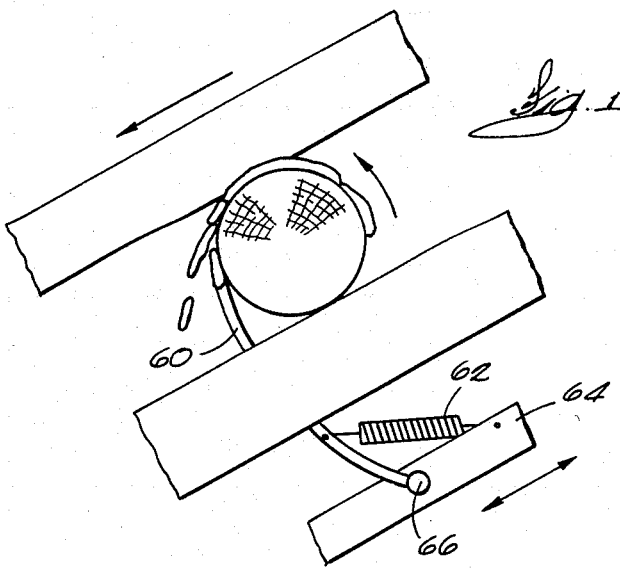
FIG. 11 is an enlarged view illustrating the bark scraping tool of the present invention.

The present apparatus and method can, however, be adapted to also remove the bark, thereby eliminating the need for additional debarking apparatus. In FIG. 11, a scraping tool 60 is illustrated, which operates against the log to dislodge the bark pieces therefrom. The scraping tool 60 can be similar to those used in ring debarkers, or the like, in which a spring 62 is provided to urge the tool against the log and under the bark. The tool 60 is pivotally mounted on a supporting member 64 at pivot point 66, and will be slidably mounted on supporting apparatus parallel to the knives. Thus, as the log rolls along the cutting bed assemblies, the scraping tool 60 will slide from one end of the knife to the opposite end of the knife, chipping the bark therefrom, as the log advances.

Figure 12:
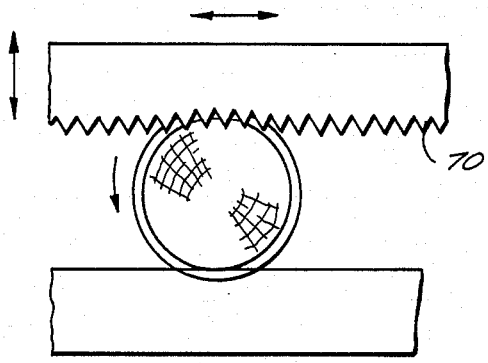
FIG. 12 illustrates a modified cutting assembly for the present debarking apparatus.
Figure 13:
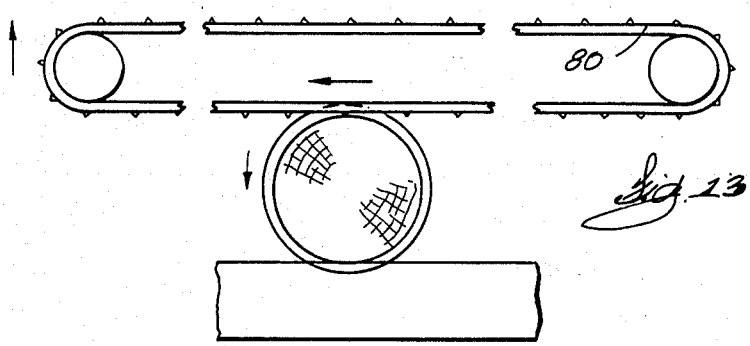
FIG. 13 illustrates yet another embodiment of a suitable cutting apparatus for the present debarking apparatus.
Figure 14:
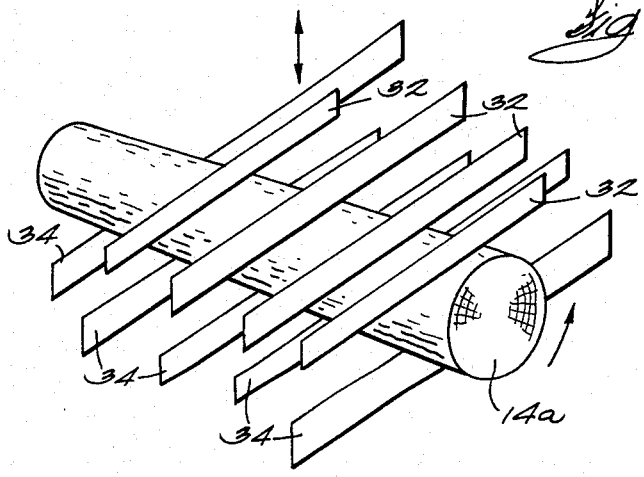
FIG. 14 is a schematic representaiton of a knife arragement for the present debarking apparatus.

Knife-type cutting edges have been described for the upper and lower cutting bed assemblies previously herein; however, it should be recognized that other types of cutting mechanisms can be utilized. For example, FIG. 12 illustrates a saw tooth edge 70 for one of the cutting devices, which may oscillate during operation, and FIG. 13 illustrates a cutting chain 80 for one of the cutting assemblies. Appropriate driving mechanisms for the chain are not shown. The modifications shown in FIGS. 12 and 13 can be used to replace some or all of the knife-like edges, to perform the helical cuts; or, alternatively, the modifications can be provided to grip rather than cut the bark. Placed between other cutting edges, a gripping edge or chain will aid in rolling the log as the upper bed is advanced.

Previously herein, the lower bed cutting assembly has been described to be stationary; however, it should be realized that the upper bed could be stationary and the lower bed movable or, alternatively, the upper and lower beds can be movable in opposite directions. As yet as further modification, the cutting assemblies can be stationary, and the log pulled therebetween by gripping chains, edges or other grabbing mechanisms similar to that described above, operating above or below the log. If stationary cutting edges are used, it is likely that a plurality of gripping and pulling chains similar to chain 80 would be required, positioned at various locations between cutting edges.

Figure 2:
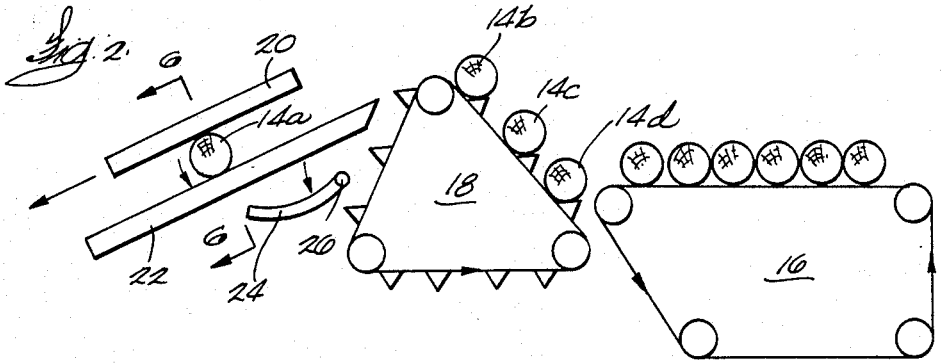
FIG. 2 is a schematic illustration of the debarking process of FIG. 1, but showing the present debarking apparatus part way through the debarking procedure.
Figure 3:
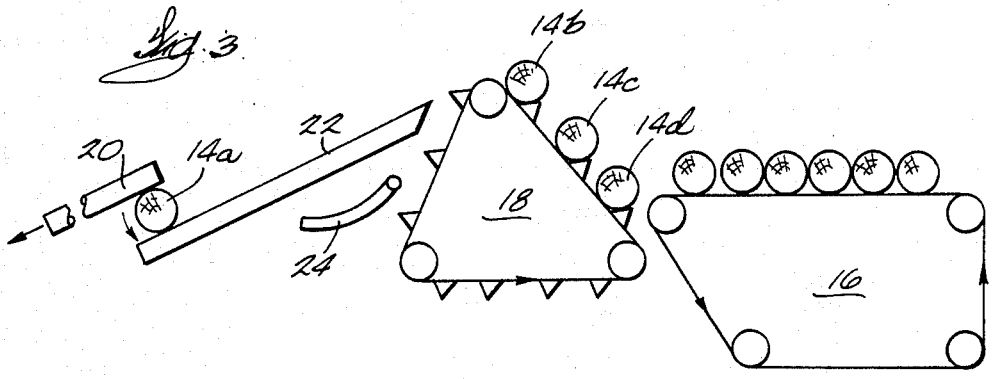
FIG. 3 is a schematic illustration similar to the previous figures, depicting the debarking apparatus at completion of the debarking step.

In the use and operation of a log pretreating and debarking apparatus of the present invention, and of the embodiment illustrated in FIGS. 1 through 5, logs are loaded on the supply conveyor 16 by a crane or the like, and are advanced to the singling supply conveyor 18. As shown in FIGS. 4 and 5, the upper bed cutting assembly 20 is elevated and out of the way during the log loading steps. A single log is advanced onto the lower bed cutting assembly and is retained and positioned by the log positioner 24. The upper bed cutting assembly is lowered against the log with sufficient force to cause the cutting edges 28 and 30 of the upper and lower bed cutting assemblies to penetrate the bark layer of the log. When appropriate sensing mechanisms are provided, the circumference of the log is calculated, and the upper bed assembly is moved parallel to the lower bed assembly, as shown in FIGS. 2 and 3. As the log is advanced in a rolling action, each of the cutting edges creates a helical slit in the bark layer, intersecting with adjacent slits. When the upper bed cutting assembly has advanced a calculated distance related to the log circumference, forward advancement is stopped, and the upper bed cutting assembly is raised out of the way, permitting the log to roll from the lower bed cutting assembly onto conveyors or the like for subsequent handling.

If the apparatus is used as a preconditioning device, after being pretreated, the log is processed through a ring debarker, drum debarker, or the like for actual bark removal. As described previously, the present invention greatly facilitates and simplifies bark removal, eliminating many of he problems associated with eucalyptus, aspen, or the like. The present invention, whether used as a preterater or as a total debarker, may eliminate the need for further bark handling apparatus, such as hoggers or the like, utilized to reduce bark size.

If the present invention is used as a total debarker, as the log end reaches a knife end, the bark scraping tool 60 contacts the log and begins scraping the bark pieces therefrom. As the log advances, the scraping tool slides on its supporting frame along the respective knife with which it is associated. Normally, the scraping tools are provided on the lower bed, and the bark pieces will fall through the lower bed to be collected for further handling. After the log passes fully over a knife, the scraping tool returns to the knife and nearest the loading end of the apparatus.

In processing frozen logs, or the like, in which bark removal may be difficult, it may be advantageous to provide a flow of electrical current to the knife edges, to be imparted to the interface between the bark layer and the log. The rapid heating of the moisture in the interface will assist in separating the bark from the log.

The present invention will provide many process advantages. Since the bark cutting and scraping devices can adjust in position to respond to varying log surface configurations, bark removal efficiency, as measured by the percentage of bark removed, is high. The need for multiple debarking steps, in most instances, will be eliminated. If subsequent log handling process steps would be improved thereby, log sorting can be performed easily as logs are removed from the apparatus. If log diameter or circumference has been calculated, deflecting gates can direct different size logs to different process paths as the logs roll off the lower bed assembly.

While a preferred embodiment and several modifications of a bark pretreating and removing method and apparatus have been shown and described in detail therein, it should be recognized that various changes and modifications can be made without departing from the scope of the present invention.

I claim:

1. An apparatus for removing a bark layer from a log comprising:

a first cutting bed means for slitting the bark layer on the log in a first series of generally helical cuts;

a second cutting bed means for scoring the bark on the log in a second series of generally helical cuts;

said first and second cutting bed means being oppositely facing and each having a plurality of parallel, spaced cutting members disposed relative to each other, so that said first and second sets of generally helical cuts intersect perriodically around the log circumference, thereby defining discrete bark pieces of nominal size;

means for rolling logs between said beds with the longitudinal extent of said logs being disposed at an angle with respect to said cutting members, and scraping means for dislodging the discrete bark pieces from the log.

2. An apparatus for removing bark from a log, as defined in claim 1, in which said second bed is stationary and transport means are provided for said first bed to move said first bed over said second bed with a log therebetween.

3. An apparatus for removing bark from a log, as defined in claim 2, in which said cutting members are knives having sharpened edges.

4. An apparatus for removing bark from a log, as defined in claim 2, in which said cutting members are cutting chains.

5. An apparatus for removing bark from a log, as defined in claim 2, in which electric circuit means are provided operatively connected to said cutting members for imparting an electrical current below the bark layer of the log.

6. An apparatus for removing bark from a log, as defined in claim 2, in which said scraping means includes a plurality of scraping tools slidable along the cutting members.

7. An apparatus for removing bark from a log, as defined in claim 2, in which sensing means are provided for calculating the size of a log to be debarked, and for controlling the length of movement of said first bed over said second bed in response thereto.

8. An apparatus for removing bark from a log, as defined in claim 2, in which said first and second beds are disposed at an angle to the horizontal.

9. An apparatus for removing bark from a log, as defined in claim 1, in which said cutting members are vertically, resiliently mounted for vertical adjustment responsive to the log surface.

10. An apparatus for removing bark from a log, as defined in claim 2, in which a log positioner is provided near one end of said second bed, for receiving and positioning a log thereon, and said log positioner is retractable to allow a log to roll thereover.

11. An apparatus for removing bark from a log, as defined in claim 10, in which said cutting members are knives having sharpened edges, and said log positioner extends upwardly between said knives of said second bed.

12. An apparatus for removing bark from a log, as defined in claim 1 in which said means for rolling logs includes transport means gripping the log and pulling the log between said frist and second cutting means.

13. An apparatus for removing bark from a log, as defined in claim 12 in which said transport means includes a chain revolving between at least some of said cutting members, said chain including apparatus for gripping a log.

14. An apparatus for pretreating a log prior to removing bark therefrom comprising:

first cutting bed means for slitting the bark;

second cutting bed means for slitting the bark in cuts intersecting with cuts made by said first cutting means;

said first and second cutting bed means being oppositely facing, and each bed including a plurality of parallel spaced cutting members disposed at an angle with respect to a log being pretreated;

means for causing relative movement between a log being pretreated and said first and second cutting means, causing the cuts made by said cutting means to surround the log.

15. An apparatus for pretreating a log, as defined in claim 14, in which log positioning apparatus is provided for receiving and positioning a log on said second bed; and lifting apparatus connected to said first bed is provided for raising said first bed from the path of a log being loaded on said second bed.

16. An apparatus for pretreating a log prior to removing the bark therefrom, as defined in claim 15, in which transport means are provided for moving said first bed substantialy parallel to said second bed, with a log positioned therebetween, causing said log to roll along said second bed.

17. An apparatus for pretreating a log prior to removing back therefrom, as defined in claim 15, in which gripping means are provided between said cutting members for grapsing a log, and said gripping means are transportable fromn one end of said beds to another end of said beds for rolling the log between said beds.

18. A method for removing back from a log comprising:

scoring the log in a first set of substantially parallel helical cuts penetrating the bark layer;

scoring the log in a second series of generally parallel helical cuts penetrating the bark layer, said second series of cuts intersecting with said first series of cuts to define discrete bark pieces;

rolling the log between cutting means for simultaneously performing said first and second scoring steps; and scraping the discrete bark pieces from the log.

19. A method for removing bark from a log, as defined in claim 18, and further including the steps of receiving a log between apparatus for performing said first and second scoring steps; and moving said apparatus relative to each other, thereby causing the log to rotate therebetween.

20. A method for removing back from a log, as defined in claim 18, including the step of providing an electrical charge below the bark layer.

21. A method for removing bark from a log, as defined in claim 18, and further including the steps of sensing and determining the size of a log from which the bark will be removed, rolling the log between cutting means for simultaneously performing said first and second scoring steps, and controlling the duration of said rolling step with respect to the size of the log.

22. A method for removing bark from a log, as defined in claim 18, including the step of transporting the log from apparatus performing said scoring steps to separate apparatus for performing said scraping step.

23. A method for removing bark from a log, as defined in claim 18, wherein said scraping step is performed simultaneously with said scoring steps.

* * * * *